US006783049B2

(12) United States Patent
Rosenbaum

(10) Patent No.: US 6,783,049 B2
(45) Date of Patent: Aug. 31, 2004

(54) SETTING TOOL

(75) Inventor: Ulrich Rosenbaum, Wangs (CH)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/310,093

(22) Filed: Dec. 4, 2002

(65) Prior Publication Data

US 2003/0116605 A1 Jun. 26, 2003

(30) Foreign Application Priority Data

Dec. 10, 2001 (DE) ..... 101 60 575

(51) Int. Cl.[7] ..... B25C 1/04

(52) U.S. Cl. ..... 227/130; 227/9; 227/10; 227/156; 123/46 SC; 123/46 R; 123/46 H

(58) Field of Search ..... 227/9–10, 130, 227/156; 123/46 R, 46 A, 46 B, 46 SC, 46 H

(56) References Cited

U.S. PATENT DOCUMENTS 4,522,162 A * 6/1985 Nikolich ..... 123/46 SC
5,263,439 A * 11/1993 Doherty et al. ..... 123/46 SC
5,988,477 A * 11/1999 Deieso et al. ..... 227/130
6,179,192 B1 * 1/2001 Weinger et al. ..... 227/156
6,526,926 B1 * 3/2003 Towfighi ..... 123/46 R

* cited by examiner

*Primary Examiner*—Stephen F. Gerrity
*Assistant Examiner*—Michelle Lopez
(74) *Attorney, Agent, or Firm*—Sidley Austin Brown & Wood, LLP

(57) ABSTRACT

A fluid-fuel operated setting tool for driving in fastening elements includes a housing (11) with a combustion chamber provided therein for combusting fluid fuel, with a released energy of combustion of the fluid being used for driving in a fastening element, and a reservoir (20, 20', 20") for storing the fluid fuel and attached to the tool housing and having, in a direction parallel to its longitudinal axis (22), a jacket (21) shape and habit of which are defined by inscribed and circumscribing envelope circles (211, 212), with the cricumscribing envelope circle having a size of its circumference greater than the size of the circumference of the insribed envelope circle.

8 Claims, 5 Drawing Sheets

SETTING TOOL

BACKGROUND OF THE INVENTION

1. Field of Invention

The present invention relates to a fluid fuel-operated setting tool for driving-in fastening elements and including a housing with a combustion chamber provided therein for combusting fluid fuel, with a released energy of combustion of the fluid fuel being used for driving in a fastening element, and a reservoir for storing the fluid fuel and from which the fluid fuel is fed to the combustion chamber and mounted on the housing.

2. Description of the Prior Art

Setting tools of the type described above are disclosed, e.g., in German Publication DE-198 53 555 A1 and U.S. Pat. No. 4,403,722. In the known setting tools, the tool-operating fuel is stored in elongated cylindrical containers or reservoirs which are arranged in the housing of setting tools. The gaseous or liquid fuel is fed to the combustion chamber by using a metering valve. The energy, which is released upon combustion of the fuel, is used, at least partially, for driving a piston that drives a to-be-set nail, pin, etc. . . . in a substrate.

The possibilities of arrangement of the fuel containers or fuel reservoirs on setting tools are rather limited because of the shape of the containers and reservoirs. German Publication DE-198 53 555 A1 discloses an arrangement of a fuel container in the handle of a setting tool. The drawback of this arrangement consists in that because of a limited available space in the handle, the fuel container or cartridge cannot exceed a certain size. In setting tool with a large power stage, the fuel consumption is very high, and the container or cartridge should be replaced after a very short use of the setting tool.

U.S. Pat. No. 4,403,722 discloses a setting tool in which a fuel reservoirs, which is formed as an elongate cylinder is arranged between the combustion space and the handle. This arrangement, in addition to a limited fuel supply, has a drawback which consists in that because of an increased distance between the handle and center of gravity of the setting tool, this setting tool is difficult to handle.

Accordingly, an object of the present invention is to provide a setting tool of the type described above in which the drawbacks of the conventional setting tools are eliminated, and the setting tool has a compact design.

SUMMARY OF THE INVENTION

This and other objects of the present invention, which will become apparent herein after are achieved by providing a fluid-fuel operated setting tool of the type described above in which the fuel reservoir has, in a direction parallel to its longitudinal axis, a jacket shape and habit of which are defined b inscribed and circumscribed, substantially similar envelope circle, with the fuel reservoir being so formed that in a direction perpendicular to the longitudinal axis of the fuel reservoir, the jacket envelope defining, inscribed and circumscribing envelope circles stay in relationship such that a size of a circumference of the circumscribing envelope circle is greater than a size of a circumference of the inscribed envelope circle, preferably in more than two times, as a result, a width of the fuel reservoir exceeds the reservoir height in more than two times.

The fuel reservoir according to the present invention is formed, with respect to its inner space of convex and/or concave jacket sections which can be adapted to the respective outer surface of the tool housing, so that the reservoir can be harmoniously adapted to the shape of the tool housing.

The fuel reservoir jacket can be formed of straight and bent sections and have one or more edges. A reservoir with such a jacket can be arranged in the setting tool or outside of the setting tool in which to this end, a spandrel can be provided. This is possible because a reservoir can be adapted to a geometry of the tool housing.

Advantageously, the reservoir is releasably mounted on the setting tool, and is reversibly secured thereto with appropriate connection means. This permits an easy and quick replacement of the reservoir.

Advantageously, the reservoir is provided with a contact surface that permits to formlockingly support the reservoir on the tool housing. This insures an easy access to the reservoir and provides for a favorable visual impression.

Advantageously, the connection or mounting means provides for a releasable connection of the reservoir with the fuel feeding conduit in the tool housing.

Advantageously, the fuel reservoir is mounted on a periphery of a central housing section in a spaced relationship to a handle of the setting tool, with the longitudinal axis of the fuel reservoir extending parallel to a longitudinal axis of the setting tool. The arrangement of the reservoir in a spaced relationship to the handle provides sufficient space for the user to conveniently grip the handle, which facilitates handling of the setting tool. The arrangement of the reservoir along an axis parallel to the setting tool axis provides for a favorable location of the center of gravity of the tool with the mounted reservoir.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENTS

Figure 1:
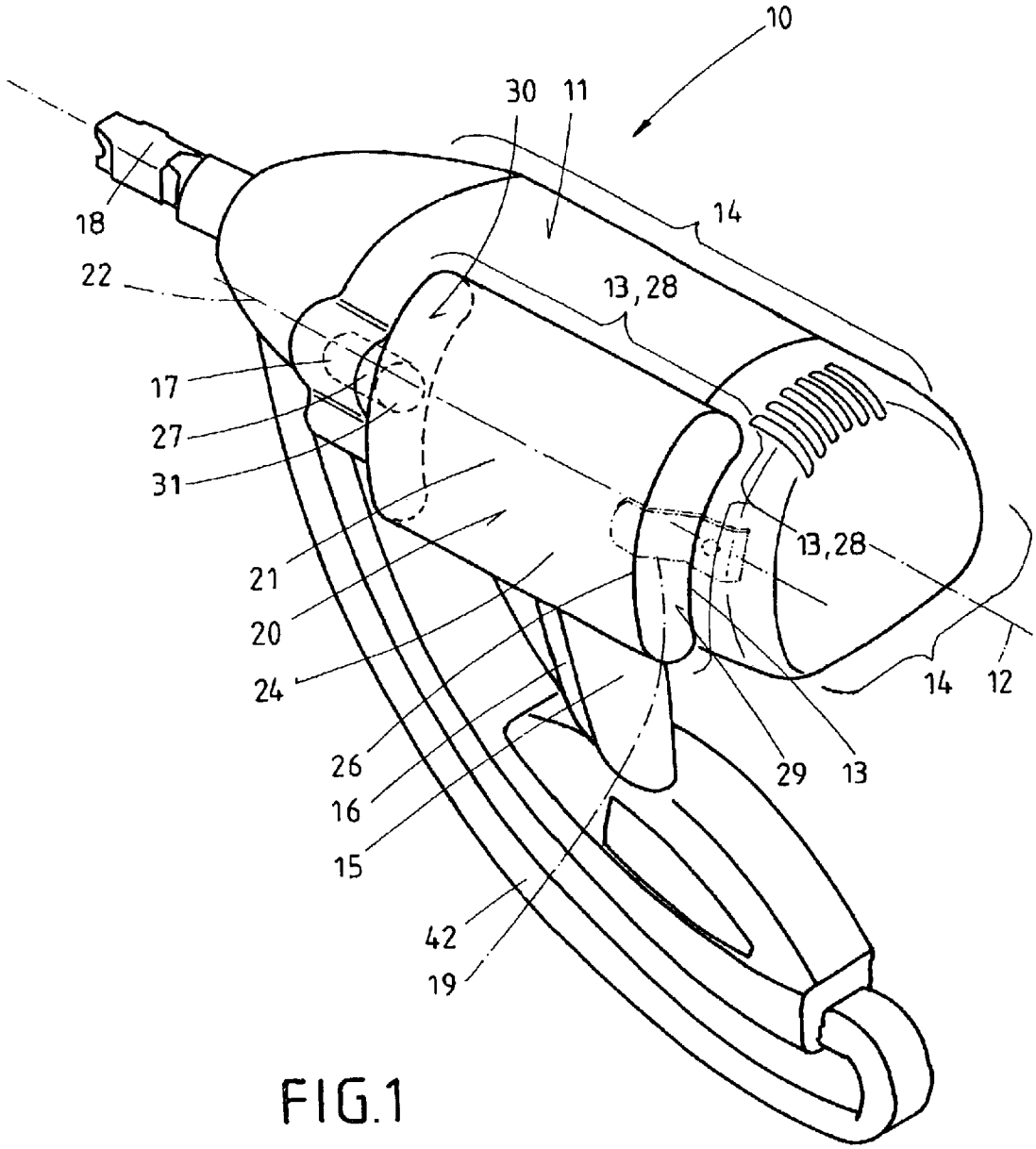
FIG. 1 shows a perspective view of a first embodiment of a setting tool according to the present invention with a fuel reservoir mounted on the setting tool.

A first embodiment of a setting tool 10 and a fuel reservoir 20 according to the present invention are shown, as discussed above, in FIGS. 1 and 6. The setting tool 10 has a housing 11 in which the tool mechanics and, if necessary, the tool electronics, in particular for controlling the fuel delivery and the ignition of the fuel contained in the combustion chamber, are located. On the housing 11, there is provided a handle 15 with a trip switch 16 for actuating the setting tool and starting the setting process. The setting tool 10 further includes a pin guide, the setting direction side, end piece 18 of which is shown in FIG. 1. Before actuation of the setting tool, a bolt, nail or the like is advanced into the pin guide 18. Upon actuation of the trip switch 16, an explosive combustion of the fuel in the tool combustion chamber is initiated. The combustion of fuel leads to displacement of the drive piston that drives, e.g., the nail, which is located in the pin guide, into e.g., constructional component. Conventionally, bolts, nails, etc. . . . are arranged in a magazine, such as a magazine 42 shown in the drawings, and are advanced into the pin guide automatically.

The fuel for the setting process, in the embodiments of the setting tool shown in the drawings is fed from a fuel reservoir arranged outside of the tool housing. In the embodiment shown in FIG. 1, the fuel is fed from the reservoir 20 mounted on the housing 11. The reservoir 20 has an elongate shape and extends along a longitudinal axis 22 which extends substantially parallel to the tool axis 12 of the setting tool 10. The fuel reservoir 20 has a jacket 21 that surround the loading chamber. The jacket 21 has a bottom 29 and an end surface 30 in which a fuel outlet is provided. Also provided on the end surface 30, a receptacle 31 and a connection member 27 that cooperates with a matching connection member 17 provided on the housing for releasably securing the fuel reservoir 20 on the housing 11. The connection members 17, 27 also provided, in the embodiment shown in FIG. 1, for connection between the fuel reservoir 20 and a tool-side, fuel conduit leading to the tool combustion chamber. In order to prevent the fuel reservoir from inadvertently falling off the setting tool during the operation of the setting tool 10, securing means 19 is provided, e.g., in the region of the bottom 29. The securing means 19 is secured at one of its end to the housing 11 and with its other end engages the fuel reservoir 20 from behind, preventing disconnection of the connection members 17 and 27. The jacket 21 of the fuel reservoir 20 has a concave surface section 23 that forms a contact surface 28 abutting the outer surface section 13 of the housing 11 of the setting tool 10. The jacket 21 further has three convex surface sections 24. The shape of the reservoir 20, which is defined by the concave surface section 23 and the free convex surfaces 24 insures a reliable support of the reservoir 20 on the tool housing 10.

Figure 6:
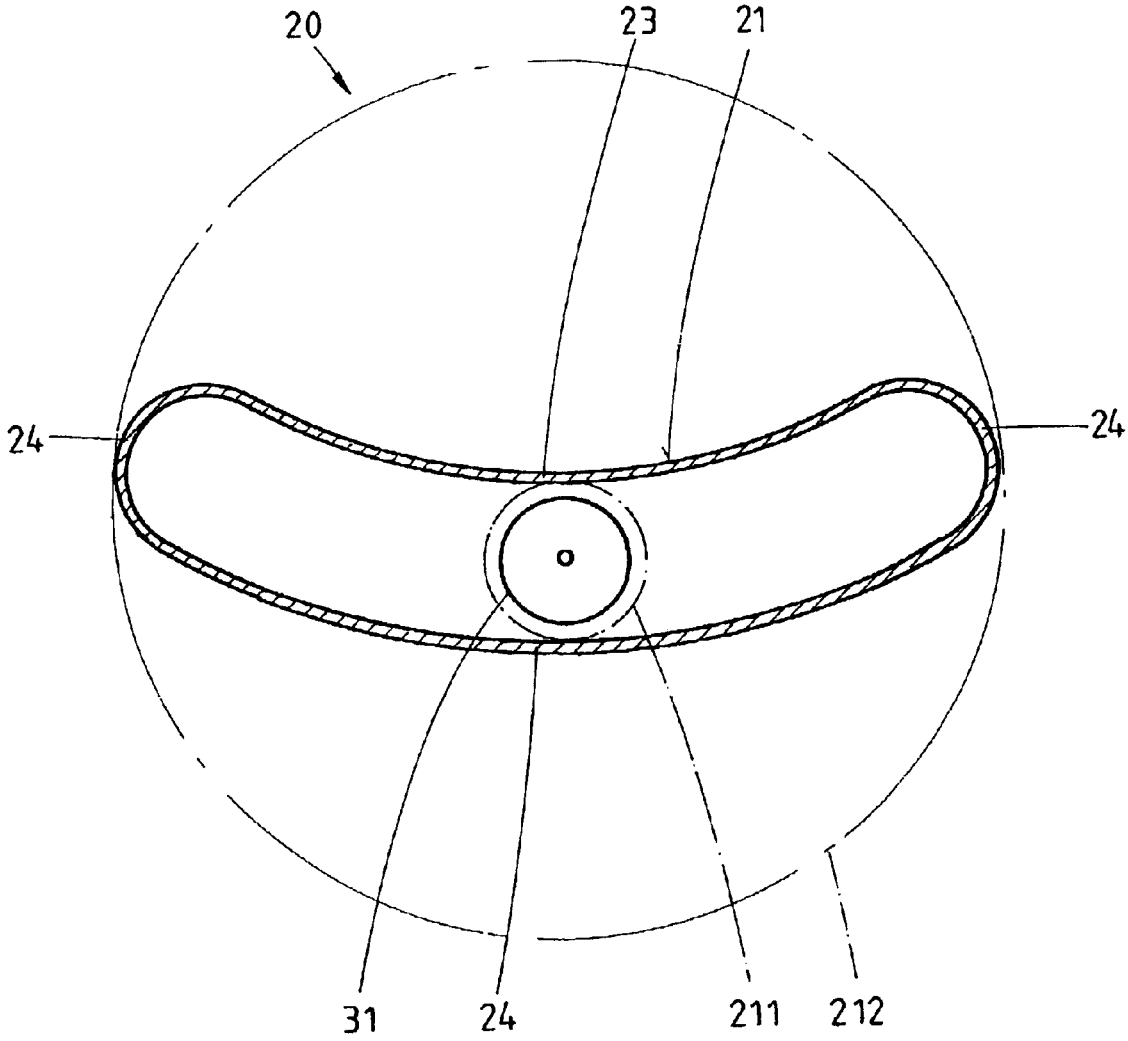
FIG. 6 shows a cross-sectional view of a fuel reservoir shown in FIG. 1.

FIG. 6 shows, as it has already been discussed, the cross-section of the fuel reservoir 20 according to the resent invention. As shown in FIG. 6, the geometry of the cross-section of the fuel reservoir 20 transverse to its axis 22 is defined by two envelope circles 211, 212, with the inscribed envelope circle 211 being substantially smaller, more than in two times, than the circumscribing envelope circle 212 that surrounds the largest longitudinal extent of the jacket 21 of the fuel reservoir 20.

Figure 2:
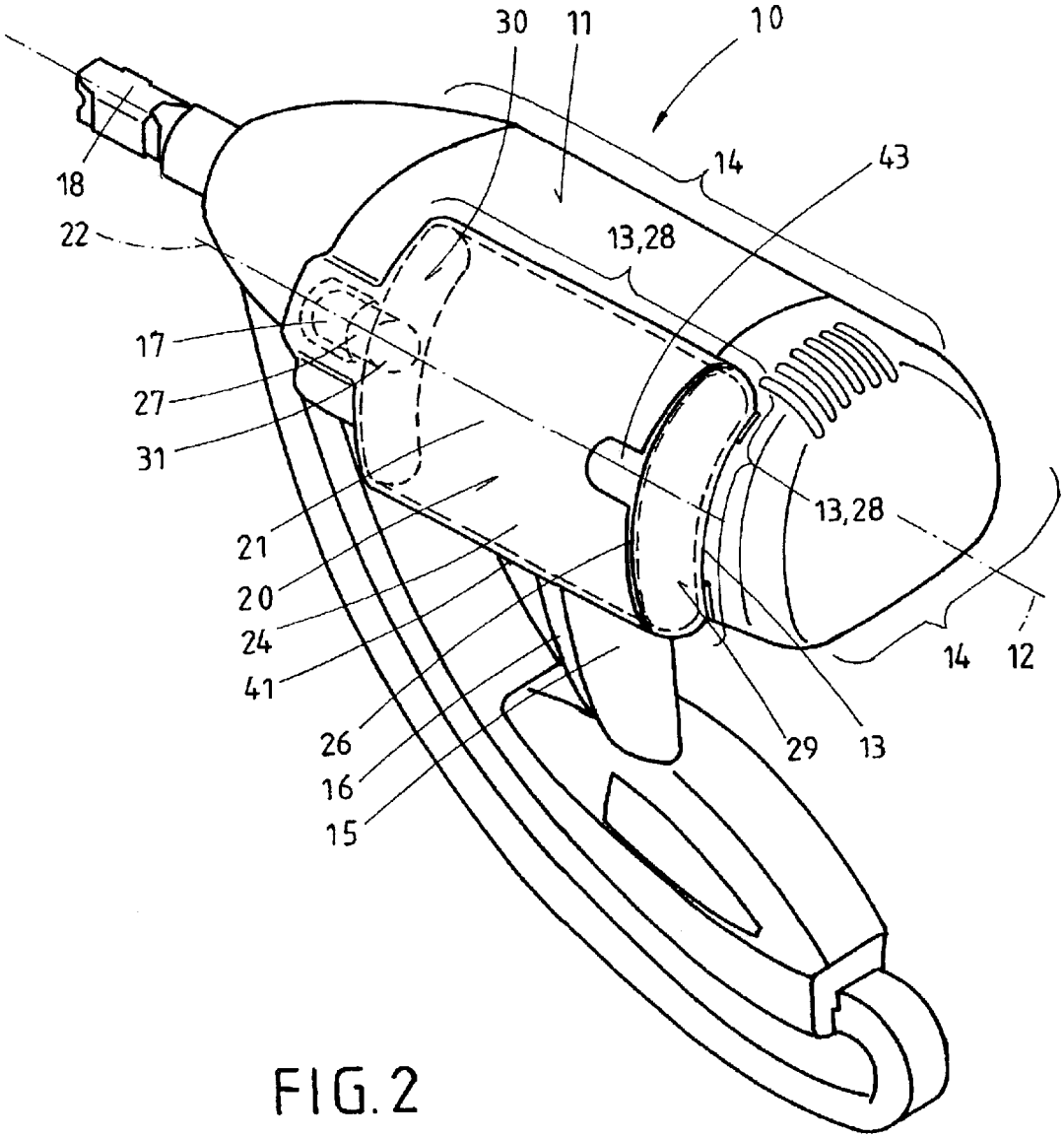
FIG. 2 shows a perspective view of a second embodiment of a setting tool according to the present invention with a mount provided on the setting tool for receiving a fuel reservoir.

FIG. 2 shows a second embodiment of a setting tool according to the present invention. In this embodiment, there is provided, on the setting tool 10, a housing pocket 41 into which the fuel reservoir 20 is pushed. As in the embodiment of FIG. 1, the reservoir 20 is releasably secured to the housing 11 with the connection members 17, 27. To facilitate the insertion and the removal of the reservoir 20, there is provided, on the outer wall of the pocket 41, at its rear end, at least one break-out 43 through which the reservoir 20 can be manually seized and retracted from the housing pocket 41 upon release of the connection members 17 and 27.

Figure 3:
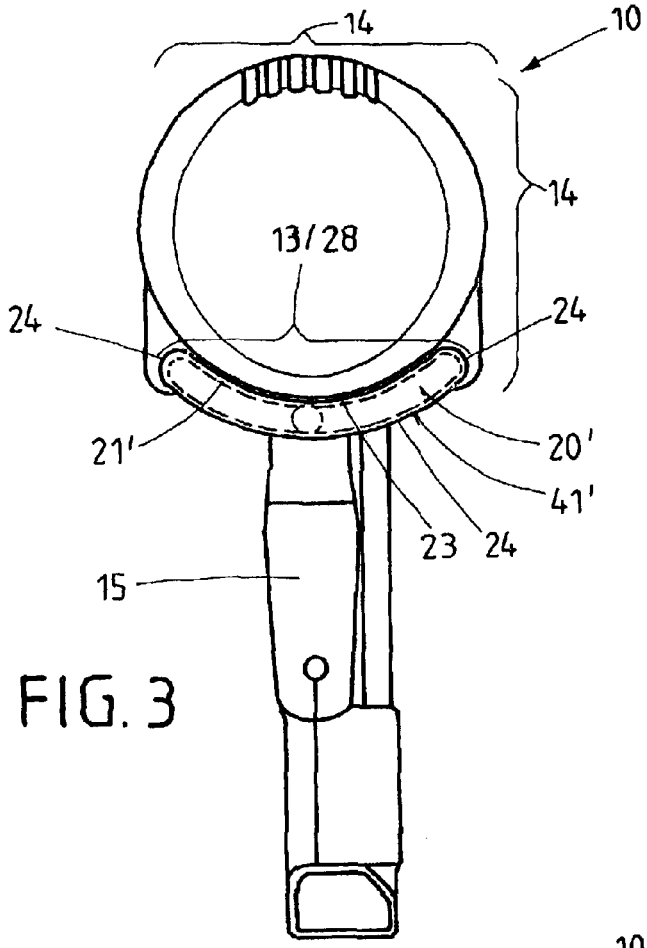
FIG. 3 shows a rear view of a third embodiment of a setting tool according to the present invention with a fuel reservoir arranged between the tool handle and the tool housing.

In the embodiment of the inventive tool shown in FIG. 3, a fuel reservoir 20' is located in al housing pocket 43' provided between a central housing section 14 and the handle 15. In this embodiment as in the embodiment of FIG. 1, the contact surface 28 of the reservoir 20' is adapted to the outer surface 13 of the housing 11. Despite the fuel reservoir 20' being arranged between the central housing section 14 and the handle 15, the setting tool 10 has a favorable center of gravity that insures an easy handling of the setting tool 10. This is because the fuel reservoir 20' is formed as a relatively flat body the geometry of which is characterized by the inscribed envelope which is substantially smaller than the circumscribing envelope (in cross-section perpendicular to the reservoir axis). As in the previous embodiments shown in FIGS. 1–2, the reservoir 20' is mounted on the central housing section 14, which provides a visual impression of proper proportionality.

Figure 4:
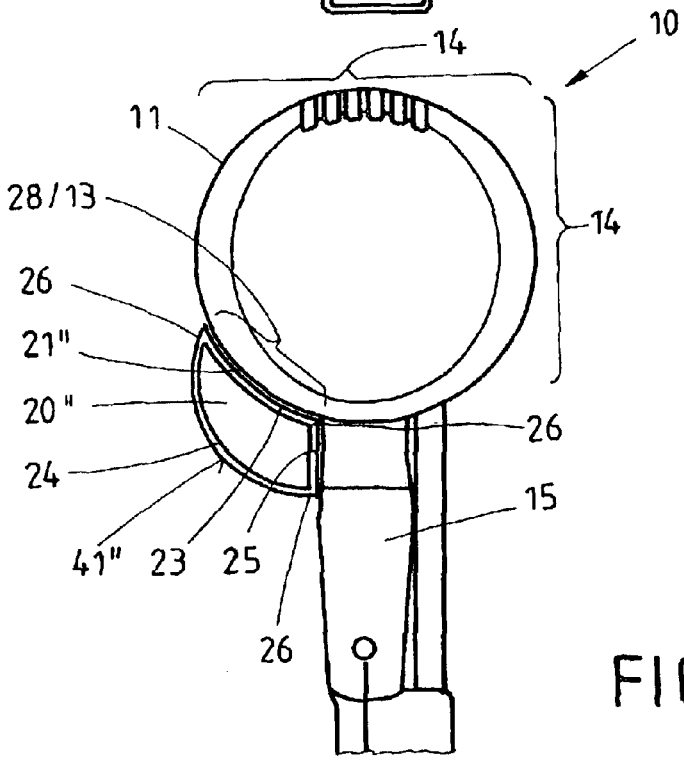
FIG. 4 shows a schematic view of a fourth embodiment of a setting tool according to the present invention with a fuel reservoir arranged between the tool handle and the tool housing in a spandrel.

FIG. 4 shows an arrangement of a fuel reservoir 20" in a spandrel between the central housing section 14 and the handle 15 in a housing pocket 41". The jacket 21" of the reservoir 20" has a linear surface section 25 and a concave 26 and convex 23, 24 surface sections which come together at a common edge 26. In the embodiment shown in FIG. 4, the housing pocket 41" forms an integral part of the housing 11.

Figure 5:
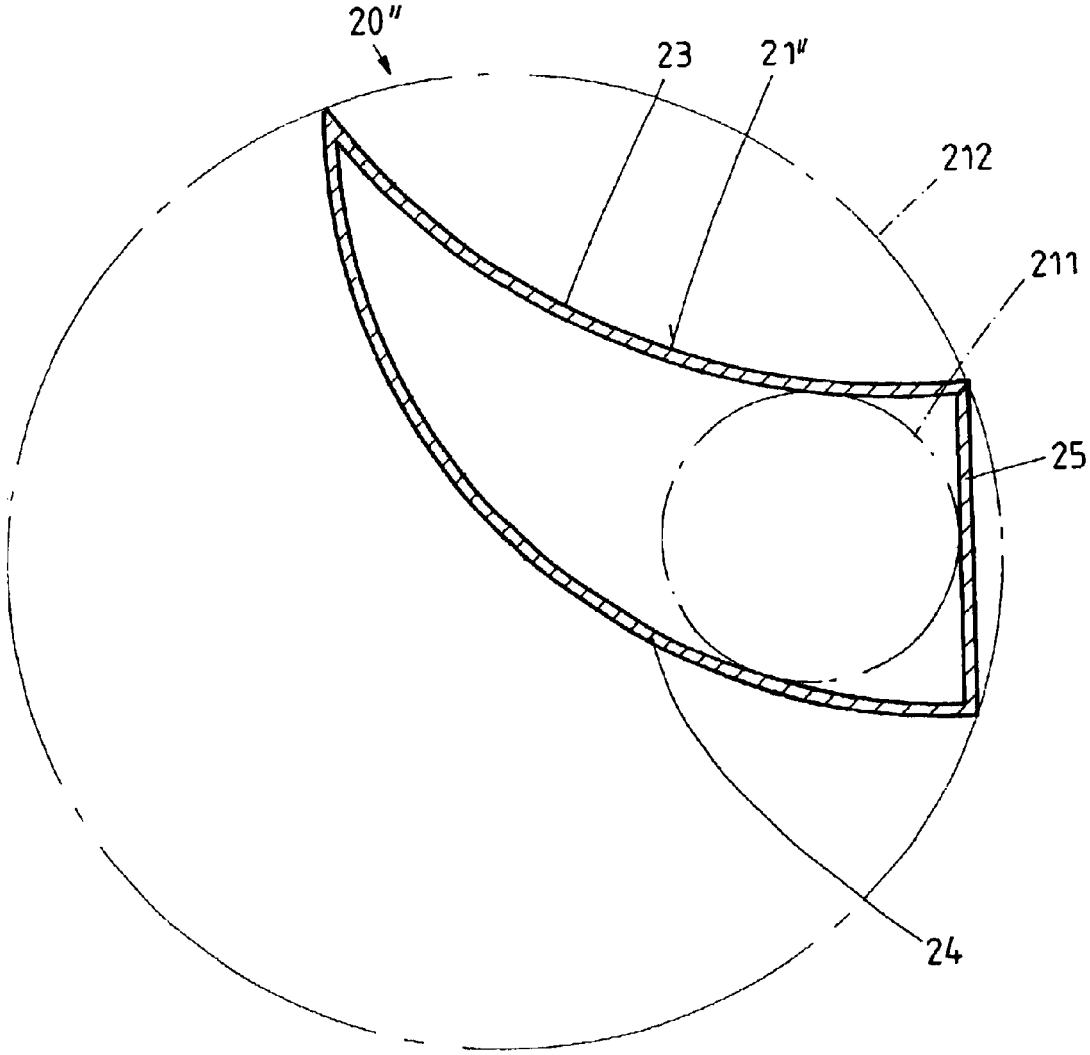
FIG. 5 shows a cross-sectional view of the fuel reservoir shown in FIG. 4.

FIG. 5, which shows the cross-section of the fuel reservoir shown in FIG. 4, illustrates that the characterizing envelope circles 211, 212 are also so formed that the inscribed envelope 211 is substantially smaller than the circumscribing envelope circle. Also, the combination of concave, convex, and linear or even surface sections 23, 24, 25 insures an optimal adaptation of the fuel reservoir 20" to the geometry or present dimensions of the tool housing 11 and the tool handle 15.

Though the present invention was shown and described with references to the preferred embodiments, such are merely illustrative of the present invention and are not to be construed as a limitation thereof and various modifications of the present invention will be apparent to those skilled in the art. It is therefore not intended that the present invention be limited to the disclosed embodiments or details thereof, and the present invention includes all variations and/or alternative embodiments within the spirit and scope of the present invention as defined by the appended claims.

What is claimed is:

1. A fluid fuel-operated setting tool for driving in fastening elements, comprising a housing (11) with a combustion chamber provided therein for combusting fluid fuel, with a released energy of combustion of the fluid fuel being used for driving in a fastening element; a reservoir (20, 20', 22") for storing the fluid fuel and from which the fluid fuel is fed to the combustion chamber; and means (17, 27) for attaching the fuel reservoir (20, 20', 22") to the housing (20), wherein the fuel reservoir (20, 20', 22") has, in a direction parallel to a longitudinal axis (22) thereof, a jacket (21) having an envelope shape and habit of which are defined by inscribed and circumscribing envelope circles (211, 212);

wherein the fuel reservoir (20, 20', 20") is formed so that in a direction perpendicular to the longitudinal axis (22) of the fuel reservoir (20, 20', 20"), the jacket envelope-defining, inscribed and circumscribing envelope circles (211, 212) stay in relationship such that a size of a circumference of the circumscribing envelope circle is greater than a size of a circumference of the inscribed envelope, and wherein the jacket (21) of the fuel reservoir (20, 20', 20") is formed of a jacket sections (23, 24) having different radii.

2. A fluid fuel-operated setting tool for driving in fastening elements, comprising a housing (11) with a combustion chamber provided therein for combusting fluid fuel, with released energy of combustion of the fluid fuel being used for driving in a fastening element; a reservoir (20, 20', 22") for storing the fluid fuel and from which the fluid fuel is fed to the combustion chamber; and means (17, 27) for attaching the fuel reservoir (20, 20', 22") to the housing (20), wherein the fuel reservoir (20, 20', 22") has, in a direction parallel to a longitudinal axis (22) thereof, a jacket (21) having an envelope shape and habit of which are defined by inscribed and circumscribing envelope circles (211, 212);

wherein the fuel reservoir (20, 20', 20") is formed so that in a direction perpendicular to the longitudinal axis (22) of the fuel reservoir (20, 20', 20"), the jacket envelope-defining, inscribed and circumscribing envelope circles (211, 212) stay in relationship such that a size of a circumference of the circumscribing envelope circle is greater than size of a circumference of the inscribed envelope circle, and wherein the jacket (21, 21',21") of the fuel reservoir includes concave (23) and convex (24) jacket section.

3. A fluid fuel-operated setting tool for driving in fastening elements, comprising a housing (11) with a combustion chamber provided therein for combusting fluid fuel, with released energy of combustion of the fluid fuel being used for driving in a fastening element; a reservoir (20, 20', 22") for storing the fluid fuel and from which the fluid fuel is fed to the combustion chamber; and means (17, 27) for attaching the fuel reservoir (20, 20', 22") to the housing (20), wherein the fuel reservoir (20, 20', 22") has, in a direction parallel to a longitudinal axis (22) thereof, a jacket (21) having an envelope shape and habit of which are defined by inscribed and circumscribing envelope circles (211, 212); wherein the fuel reservoir (20, 20', 20") is formed so that in a direction perpendicular to the longitudinal axis (22) of the fuel reservoir (20, 20', 20"), the jacket envelope-defining, inscribed and circumscribing envelope circles (211, 212) stay in relationship such that a size of a circumference of the circumscribing envelope circle is greater than size of a circumference of the inscribed envelope circle, and wherein the jacket (21, 21', 21") of the fuel reservoir (20, 20', 20") has a jacket section (28) lying on the housing (11) and having a profile corresponding to an adjoining outer surface (13) of the housing (11).

4. A fluid fuel-operated setting tool for driving in fastening elements, comprising a housing (11) with a combustion chamber provided therein for combusting fluid fuel, with released energy of combustion of the fluid fuel being used for driving in a fastening element; a reservoir (20, 20', 22") for storing the fluid fuel and from which the fluid fuel is fed to the combustion chamber; and means (17, 27) for attaching the fuel reservoir (20, 20', 22") to the housing (20), wherein the fuel reservoir (20, 20', 22") has, in a direction parallel to a longitudinal axis (22) thereof, ajacket (21) having an envelope shape and habit of which are defined by inscribed and circumscribing envelope circles (211, 212); and wherein the fuel reservoir (20, 20', 20") is formed so that in a direction perpendicular to the longitudinal axis (22) of the fuel reservoir (20, 20', 20"), the jacket envelope-defining, inscribed and circumscribing envelope circles (211, 212) stay in relationship such that a size of a circumference of the circumscribing envelope circle is greater than a size of a circumference of the inscribed envelope circle in more than two times, thereby a width of the fuel reservoir exceeds a height thereof also in more than two times.

5. A setting tool according to claim 4, wherein the fuel reservoir (20, 20', 20") is releasably connected with the tool housing (11).

6. A setting tool according to claim 4, wherein the fuel reservoir (20) has a contact surface formlockingly supported on the housing (11).

7. A setting tool according to claim 4, wherein the attaching means (17, 27) provides for a releasable connection of the fuel reservoir (20, 20', 20") with a housing side, fuel feeding conduit.

8. A setting tool according to claim 4, wherein the fuel reservoir (20, 20") is mounted on a periphery of a central housing section (14) in a spaced relationship to a handle (15) of the setting tool (10), with the longitudinal axis (22) of the fuel reservoir (20, 20") extending parallel to a longitudinal axis (12) of the setting tool (10).

* * * * *